US012507788B2

(12) United States Patent
Cruickshank

(10) Patent No.: US 12,507,788 B2
(45) Date of Patent: Dec. 30, 2025

(54) PORTABLE STAKED ACCESSORY HOLDER

(71) Applicant: Halsey Cruickshank, Brooklyn, NY (US)

(72) Inventor: Halsey Cruickshank, Brooklyn, NY (US)

( * ) Notice: Subject to any disclaimer, the term of this patent is extended or adjusted under 35 U.S.C. 154(b) by 57 days.

(21) Appl. No.: 18/349,751

(22) Filed: Jul. 10, 2023

(65) Prior Publication Data

US 2023/0346113 A1 Nov. 2, 2023

Related U.S. Application Data

(63) Continuation-in-part of application No. 17/132,523, filed on Dec. 23, 2020, now Pat. No. 11,737,549, which is a continuation-in-part of application No. 16/013,471, filed on Jun. 20, 2018, now abandoned.

(51) Int. Cl.

| | |
|---|---|
| ***A47K 1/04*** | (2006.01) |
| ***A45F 3/44*** | (2006.01) |
| *A45F 5/00* | (2006.01) |

(52) U.S. Cl.

CPC ..... *A45F 3/44* (2013.01); *A45F 5/1516* (2025.01); *A45F 5/1583* (2025.01)

(58) Field of Classification Search

CPC ..... A45F 3/44; A45F 5/1516; A45F 5/1583; H10D 30/6894; H10D 62/834; A47G 23/0225

See application file for complete search history.

(56) References Cited

U.S. PATENT DOCUMENTS

| | | | | |
|---|---|---|---|---|
| 577,764 | A | 2/1897 | Lines | |
| 3,216,166 | A | 11/1965 | Brown | |
| 3,370,820 | A * | 2/1968 | Liss | A24F 19/0092 248/312.1 |
| 4,334,661 | A | 6/1982 | Pitt | |
| 5,819,720 | A | 10/1998 | Schubert | |
| 6,575,417 | B1 | 6/2003 | Krommenakker | |
| 6,688,012 | B1 * | 2/2004 | Crain | G01C 15/06 403/109.1 |
| 7,207,450 | B1 | 4/2007 | Franklin et al. | |
| 9,554,630 | B1 * | 1/2017 | Patel | A45B 25/18 |
| 10,602,817 | B2 * | 3/2020 | Price | A45B 25/00 |
| 11,377,866 | B1 | 7/2022 | Conlon | |
| 2004/0129184 | A1 | 7/2004 | Kraker | |
| 2007/0017108 | A1 | 1/2007 | Hanson | |
| 2007/0267551 | A1 * | 11/2007 | Townsend | A61M 5/1415 248/311.2 |
| 2009/0294622 | A1 | 12/2009 | Medders et al. | |
| 2012/0187136 | A1 | 7/2012 | Smith | |
| 2014/0326283 | A1 | 11/2014 | Silberman | |
| 2016/0319543 | A1 | 11/2016 | Messina et al. | |

FOREIGN PATENT DOCUMENTS

| | | | |
|---|---|---|---|
| GB | 367925 | A | 3/1932 |

* cited by examiner

*Primary Examiner* — Amy J. Sterling

(57) ABSTRACT

A portable staked accessory holder is an apparatus that is mounted into the ground to uphold various small items. The apparatus includes a post and a stake. The stake drives into the ground. The apparatus further includes a beverage holder with an attached mobile device holder. This holder combination is mounted to the post by a spring clamp. The spring clamp allows the position of the holder combination to be adjusted.

10 Claims, 10 Drawing Sheets

PORTABLE STAKED ACCESSORY HOLDER

FIELD OF THE INVENTION

The present invention relates generally to stakes. More specifically, the invention relates portable accessory holders.

BACKGROUND OF THE INVENTION

Drinking cups and mobile devices are staples at any social event. However, it is difficult to maneuver throughout a social event while holding both a beverage and a mobile device while maintaining conversation or participating in activities. The easiest solution to this problem is to rest the beverage or mobile device on a table or flat surface. However, this allows an individual to easily forget his beverage or mobile device, the beverage to be spilled, or the mobile device to be taken.

The present invention allows a user to safely mount and easily retrieve his beverage or mobile device.

SUMMARY OF THE INVENTION

A portable staked accessory holder is an apparatus that is mounted into the ground to uphold various small items. The apparatus includes a post and a stake. The stake drives into the ground. The apparatus further includes a beverage holder with an attached mobile device holder. This holder combination is mounted to the post by a spring clamp. The spring clamp allows the position of the holder combination to be adjusted.

DETAILED DESCRIPTION OF THE INVENTION

All illustrations of the drawings are for the purpose of describing selected versions of the present invention and are not intended to limit the scope of the present invention.

The present invention is a portable staked accessory holder. The portable staked accessory holder serves as a universal mount for a variety of small items. The present invention more specifically upholds a variety of items above the ground. The present invention may be utilized during outdoor gatherings or outdoor activities. The present invention is also compact and modular, easily stored with minimal space required.

Figure 1:
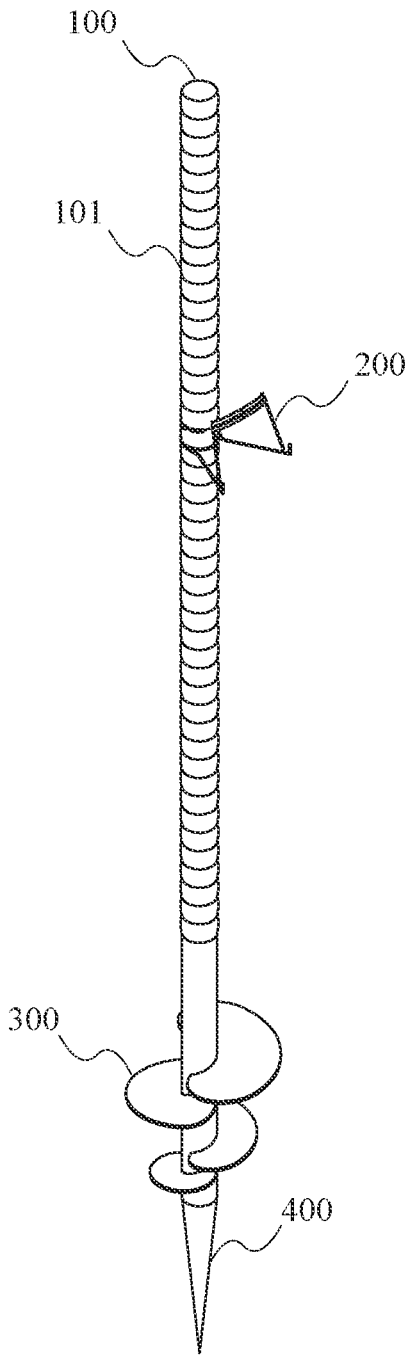
FIG. 1 is a perspective view of Embodiment 1 of the present invention.
Figure 2:
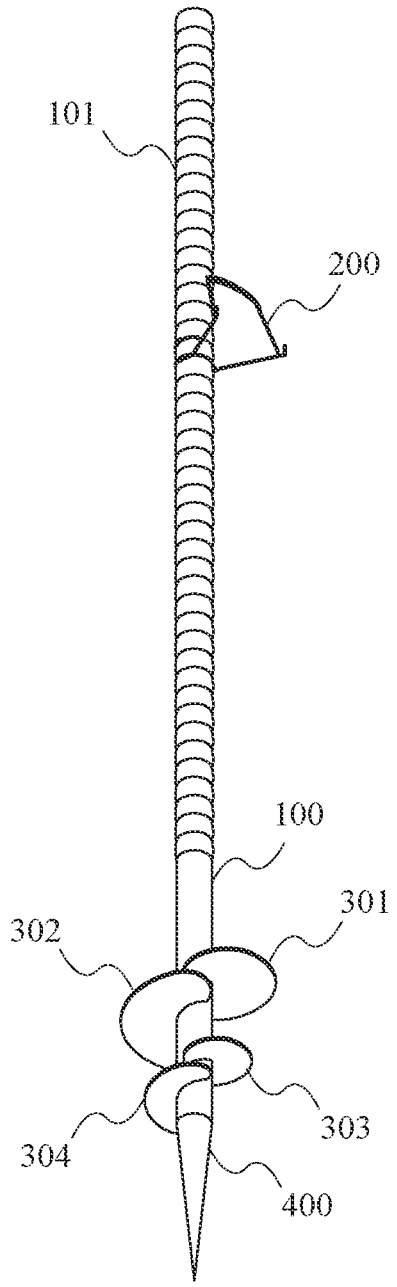
FIG. 2 is a perspective view of Embodiment 1 of the present invention.
Figure 3:
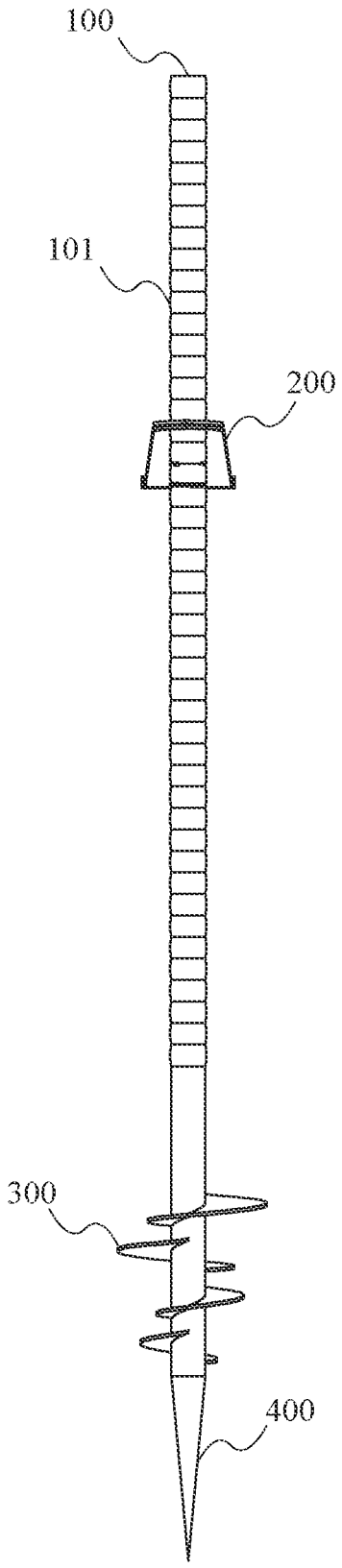
FIG. 3 is a front elevation view of Embodiment 1 of the present invention.
Figure 4:
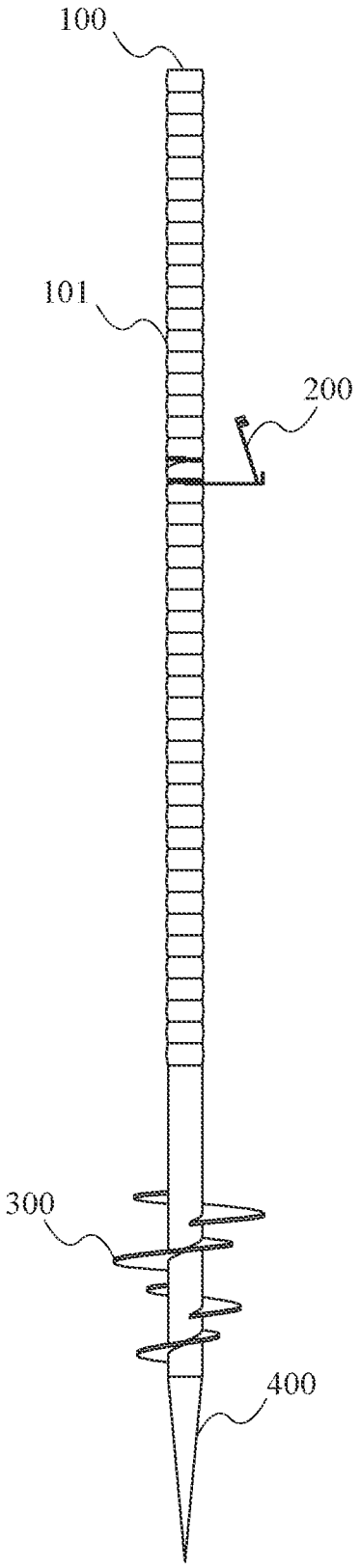
FIG. 4 is right side elevation view of Embodiment 1 of the present invention.
Figure 5:
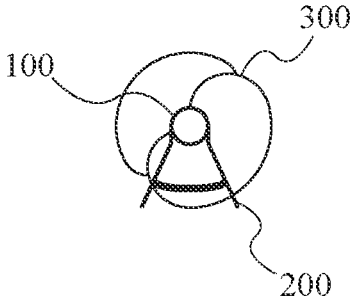
FIG. 5 is a top view of Embodiment 1 of the present invention.
Figure 6:
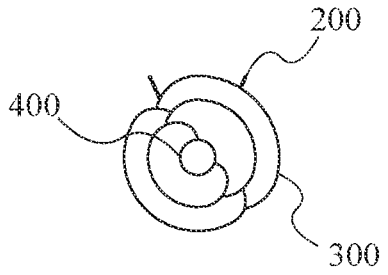
FIG. 6 is a bottom view of Embodiment 1 of the present invention.

Referring to FIGS. 1-6, the present invention comprises a portable staked accessory holder. Embodiment 1 of the present invention comprises a post 100, an accessory holder 200, a plurality of blades 300, and stake 400. The stake 400 comprises a proximal end and a pointed distal end. The post 100 includes a series of ridges 101. The ridges 101 provide additional support to the accessory holder 200 to prevent the accessory holder from slipping down the post 100. The stake 400 is connected to a lower end of the post. The stake 400 mounts the post 100 securely into the ground. The plurality of blades 300 are secured around the perimeter of the post 100. The plurality of blades 300 comprises a first set of blades and a second set of blades. The first set of blades includes the first blade 301 and the second blade 302. The second set of blades includes the third blade 303 and the fourth blade 304. In Embodiment 1, the size of blades decrease in proximity to the stake. For example, the first blade 301 is the largest, the second blade 302 is smaller than the first blade 301, the third blade 303 is smaller than the second blade 302, and the fourth blade 304 is the smallest. The post 100 is rotated as it is inserted into the ground, allowing the blades 300 to pierce the ground. The set of blades 300 stabilize the vertical orientation of the post 100.

Figure 7:
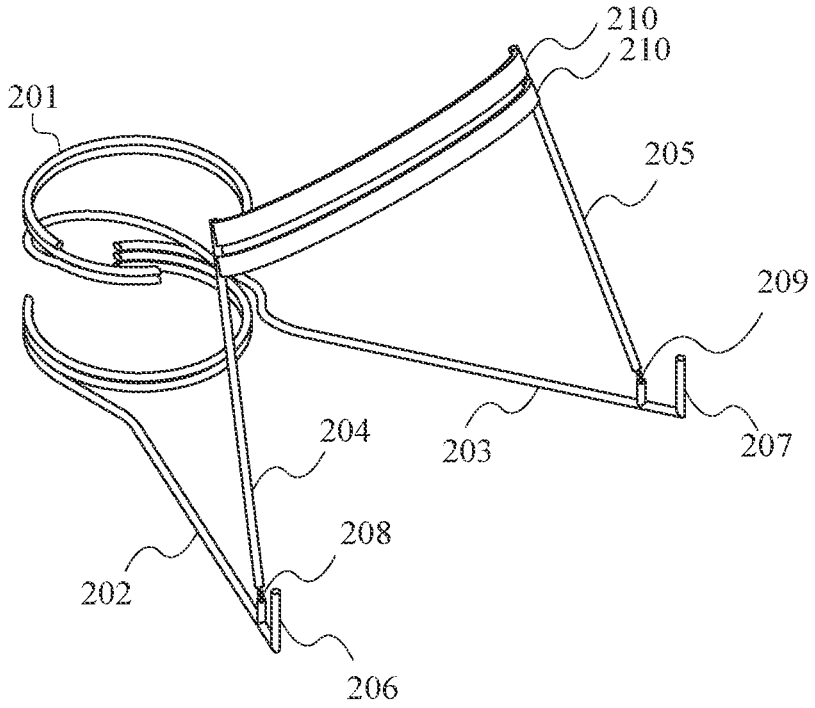
FIG. 7 is a perspective view of the accessory holder of Embodiment 1 of the present invention.
Figure 8:
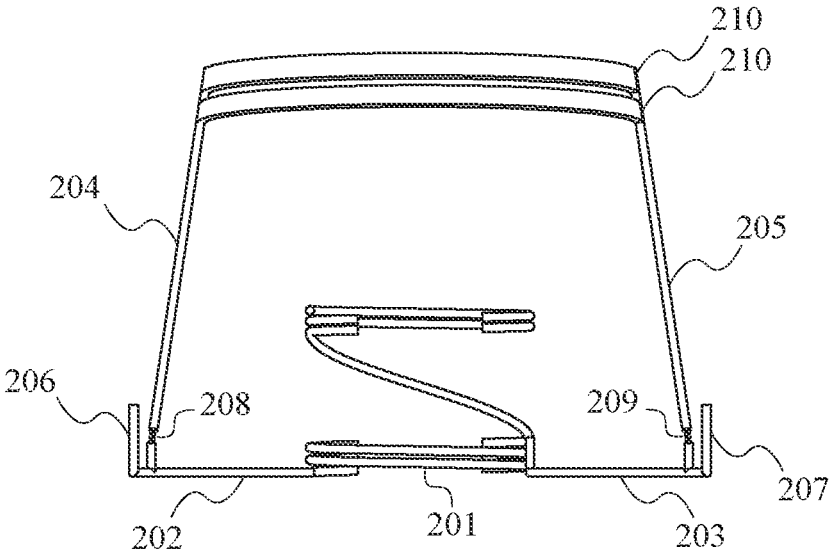
FIG. 8 is a front elevation view of the accessory holder of Embodiment 1 of the present invention.
Figure 9:
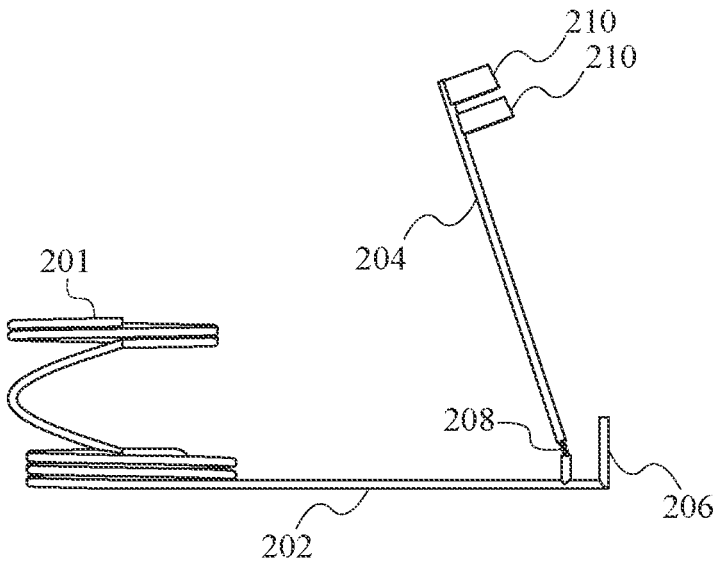
FIG. 9 is a right side elevation view of the accessory holder of Embodiment 1 of the present invention.
Figure 10:
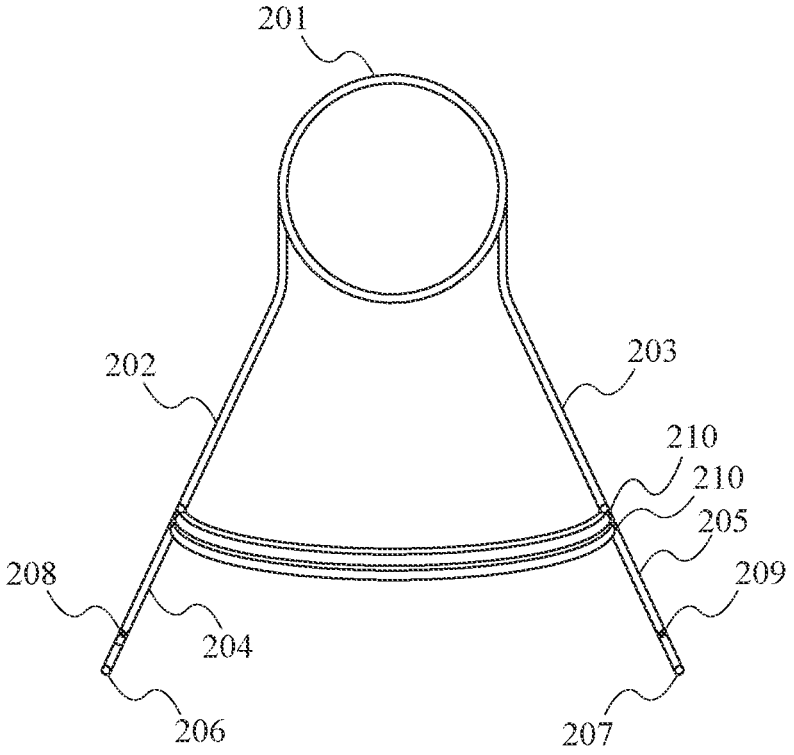
FIG. 10 is a top view of Embodiment 1 of the present invention.

FIGS. 7-10 show the accessory holder 200 of Embodiment 1 of the present invention in isolation. The accessory holder further comprises a spring clamp 201. The spring clamp provides a secure and stable connection to the post 100. A first arm 202 and a second arm 203 extend from the spring clamp 201. The first arm 202 and second arm 203 form the base of a beverage holder. A beverage is placed on top of the first arm 202 and the second arm 203, and the beverage is held in place by the elastic bands 210. A third arm 204 is connected to the first arm 202 via a first coil spring 208. A fourth arm is 205 is connected to the second arm 203 via a second coil spring 209. The first coil spring 208 and the second coil spring 209 allow the third arm 204 and the fourth arm 205 to be secured at an angle. For example, the third arm 204 and the fourth arm 205 may be at a 70-degree angle from the first arm 202 and the second arm 203, respectively. A first prong 206 is connected to the end of the first arm 202, and a second prong 207 is connected to the end of the second arm 203. The third arm 204, the fourth arm 205, the first prong 206, the second prong 207, and the elastic bands 210 form a mobile device holder.

Although the invention has been explained in relation to its preferred embodiment, it is to be understood that many other possible modifications and variations can be made without departing from the spirit and scope of the invention as hereinafter claimed.

What is claimed is:

1. A portable staked accessory holder comprising:

a post, the post comprising one or more ridges;

a stake;

an accessory holder, the accessory holder being adjustably attached to the post, and the holder including a beverage holder, a mobile device holder, and a spring clamp;

one or more blades, the blades including a first set of blades and a second set of blades, wherein the first set of blades comprise a larger radius than the second set of blades;

the stake being terminally being fixed to the post adjacent to a lower end of the post;

a first arm, the first arm being fixed to the spring clamp;

a second arm, the second arm being fixed to the spring clamp;
a third arm;
a fourth arm;
an elastic band;
the third arm being fixed to the first arm;
the fourth arm being fixed to the second arm; and
the elastic band extending from the third arm to the fourth arm.

2. The portable staked accessory holder of claim 1, wherein the mobile device holder further comprises:
a first prong;
a second prong
the first prong being fixed to the first arm; and
the second prong being fixed to the second arm.

3. The portable staked accessory holder of claim 2, wherein the mobile device holder further comprises:
a first coil spring;
a second coil spring;
the first coil spring connecting the first prong to the first arm; and
the second coil spring connecting the second prong to the second arm.

4. A portable staked accessory holder comprising:
a post;
a stake;
a first set of blades;
a second set of blades;
an accessory holder, comprising:
a beverage holder;
a mobile device holder; and
a spring clamp;
the stake being terminally fixed to the post adjacent to a lower end of the post;
the second set of blades being fixed tangentially to the post and adjacent to the lower end of the post;
the first set of blades being fixed tangentially to the post and adjacent to the second set of blades;
the spring clamp being adjustable attached to the post:
a first arm, the first arm being fixed to the spring clamp;
a second arm, the second arm being fixed to the spring clamp;
a third arm, the third arm being fixed to the first arm;
a fourth arm, the fourth arm being fixed to the second arm; and
an elastic band, the elastic band extending from the third arm to the fourth arm.

5. The portable staked accessory holder of claim 4, wherein the mobile device holder further comprises:
a first prong;
a second prong
the first prong being fixed to the first arm; and
the second prong being fixed to the second arm.

6. The portable staked accessory holder of claim 5, wherein the mobile device holder further comprises:
a first coil spring;
a second coil spring;
the first coil spring connecting the first prong to the first arm; and
the second coil spring connecting the second prong to the second arm.

7. A portable staked accessory holder, comprising:
a post;
a stake;
a first set of blades;
a second set of blades;
an accessory holder, comprising:
a spring clamp;
a first arm;
a second arm
a third arm
a fourth arm
a first prong
a second prong
an elastic band
the first arm being fixed to the spring clamp;
the second arm being fixed to the spring clamp;
the third arm being fixed to the first arm;
the fourth arm being fixed to the second arm;
the first prong being fixed to the first arm;
the second prong being fixed to the second arm; and
the elastic band being connected between the third arm and the fourth arm;
the stake being terminally fixed to a lower end of the post;
the second set of blades being fixed tangentially to the post and adjacent to the lower end of the post;
the first set of blades being fixed tangentially to the post and adjacent to the second set of blades; and
the spring clamp being adjustably attached to the post.

8. The portable staked accessory holder of claim 7, wherein the first set of blades comprises a larger radius than the second set of blades.

9. The portable staked accessory holder of claim 7, wherein the mobile device holder further comprises:
a first coil spring;
a second coil spring;
the first coil spring connecting the first prong to the first arm; and
the second coil spring connecting the second prong to the second arm.

10. The portable staked accessory holder of claim 7, wherein the post further comprises one or more ridges.

* * * * *